US011110736B1

(12) United States Patent
Pardee

(10) Patent No.: US 11,110,736 B1
(45) Date of Patent: Sep. 7, 2021

(54) WALLET ASSEMBLY

(71) Applicant: Patricia Ann Pardee, Lolo, MT (US)

(72) Inventor: Patricia Ann Pardee, Lolo, MT (US)

( * ) Notice: Subject to any disclaimer, the term of this patent is extended or adjusted under 35 U.S.C. 154(b) by 0 days.

(21) Appl. No.: 16/943,471

(22) Filed: Jul. 30, 2020

Related U.S. Application Data

(60) Provisional application No. 62/880,474, filed on Jul. 30, 2019.

(51) Int. Cl.
*B42F 7/06* (2006.01)
*A45C 11/18* (2006.01)

(52) U.S. Cl.
CPC ..... *B42F 7/06* (2013.01); *A45C 11/182* (2013.01); *B42P 2241/18* (2013.01)

(58) Field of Classification Search
CPC . A45C 11/182; B42F 7/06; B42F 7/08; B42F 17/00; B42F 13/04; B42D 3/12
USPC ..... 206/425, 232; 281/31
See application file for complete search history.

(56) References Cited

U.S. PATENT DOCUMENTS

| | | | | |
|---|---|---|---|---|
| 4,932,520 | A | 6/1990 | Clarcia | |
| 5,387,037 | A * | 2/1995 | Daitch | B42F 7/08 150/112 |
| D671,315 | S | 11/2012 | Schneider | |
| 9,902,190 | B2 * | 2/2018 | Hobbs | B42F 7/08 |
| 2004/0059689 | A1 | 3/2004 | Masden | |
| 2016/0121642 | A1 * | 5/2016 | Herbst | B42F 9/005 402/31 |

* cited by examiner

*Primary Examiner* — King M Chu
(74) *Attorney, Agent, or Firm* — Plager Schack LLP; Mark H. Plager; Michael J. O'Brien

(57) ABSTRACT

A wallet assembly is configured to provide space for wait staff to perform food ordering services. The wallet assembly has a front panel joined to a mid panel with a front upper gusset panel and a front lower gusset panel forming a front pocket therebetween. A rear panel is joined to the front panel and the mid panel with a spine. A rear opening panel is joined to the rear panel with a rear upper gusset and a rear lower gusset forming a rear pocket therebetween.

6 Claims, 4 Drawing Sheets

WALLET ASSEMBLY

RELATED APPLICATION

This application claims priority to provisional patent application U.S. Ser. No. 62/880,474 filed on Jul. 30, 2019, the entire contents of which is herein incorporated by reference.

BACKGROUND

The embodiments herein relate generally to personal accessories.

Prior to embodiments of the disclosed invention, server books promote inaccuracy and inefficiency of cash carrying and change-making due to lack of space and visibility. Other endeavors in this field include U.S. Patent Application Pre-Grant Publication 2004/0059689 filed by Masden; U.S. Design Patent D 671, 315 issued to Schneider; and U.S. Pat. No. 4,932,520 issued to Ciarcia. Embodiments of the disclosed invention solve this problem.

SUMMARY

A wallet assembly is configured to provide space for wait staff to perform food ordering services. The wallet assembly has a front panel joined to a mid panel with a front upper gusset panel and a front lower gusset panel forming a front pocket therebetween. The front panel further comprises a front panel front side and a front panel rear side. The mid panel further comprises a mid panel front side and a mid panel rear side A rear panel is joined to the front panel and the mid panel with a spine. The rear panel further comprises a rear panel front side and a rear panel rear side. A rear opening panel is joined to the rear panel with a rear upper gusset and a rear lower gusset forming a rear pocket therebetween. The rear opening panel further comprises a rear opening panel front side and a rear opening panel rear side. The front pocket and the rear pocket are configured to provide wait staff with storage for performing food ordering services.

A front panel front side plurality of fastener magnets is joined to the front panel rear side. A mid panel front side plurality of fastener magnets is joined to the mid panel front side. Magnetically coupling the front panel front side plurality of fastener magnets to the mid panel front side plurality of fastener magnets closes the front pocket. A mid panel rear side first flap, a mid panel rear side second flap, a mid panel first corner flap, and a mid panel second corner flap are joined to the mid panel rear side A rear panel front side plurality of fastener magnets is joined to the rear panel front side. A rear opening panel rear side plurality of fastener magnets is joined to the rear opening panel rear side. Magnetically coupling the rear panel front side plurality of fastener magnets to the rear opening panel rear side plurality of fastener magnets closes the rear pocket.

A rear opening panel front side first flap, a rear opening panel front side second flap, a rear opening panel first corner flap, a rear opening panel second corner flap are joined to the rear opening panel front side, and a rear opening panel front side pen holder. A coin pocket is joined to the spine and configured to be accessed with a zipper.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
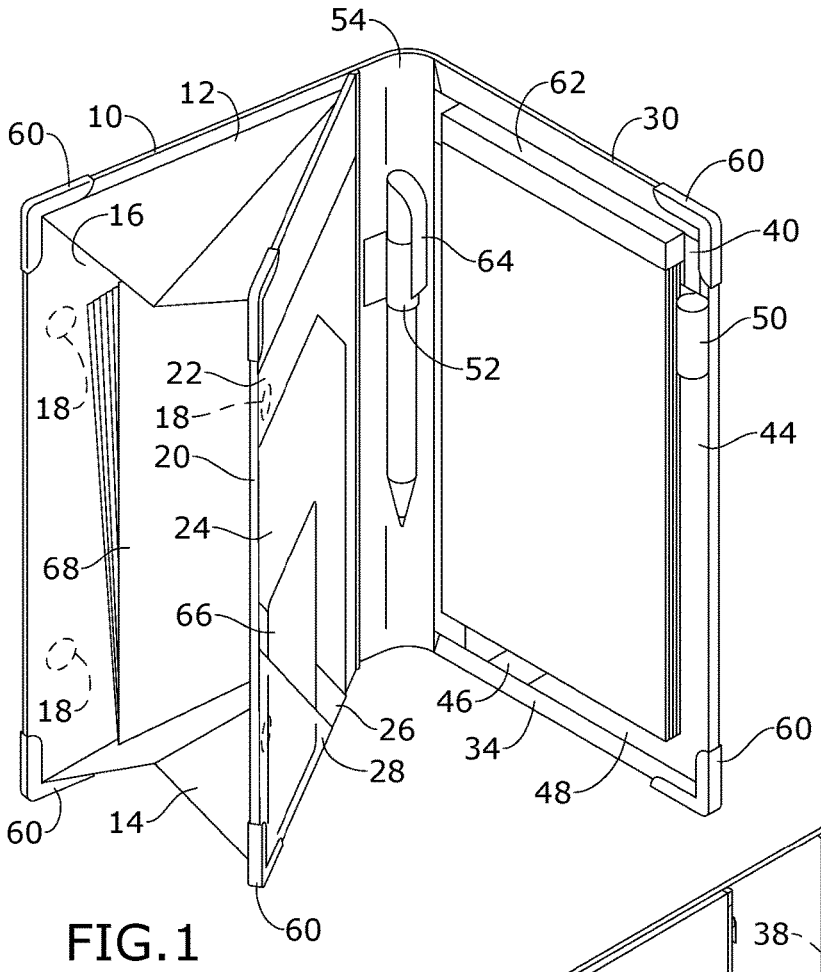
FIG. 1 shows a perspective view of one embodiment of the present invention with the front slot open.
Figure 2:
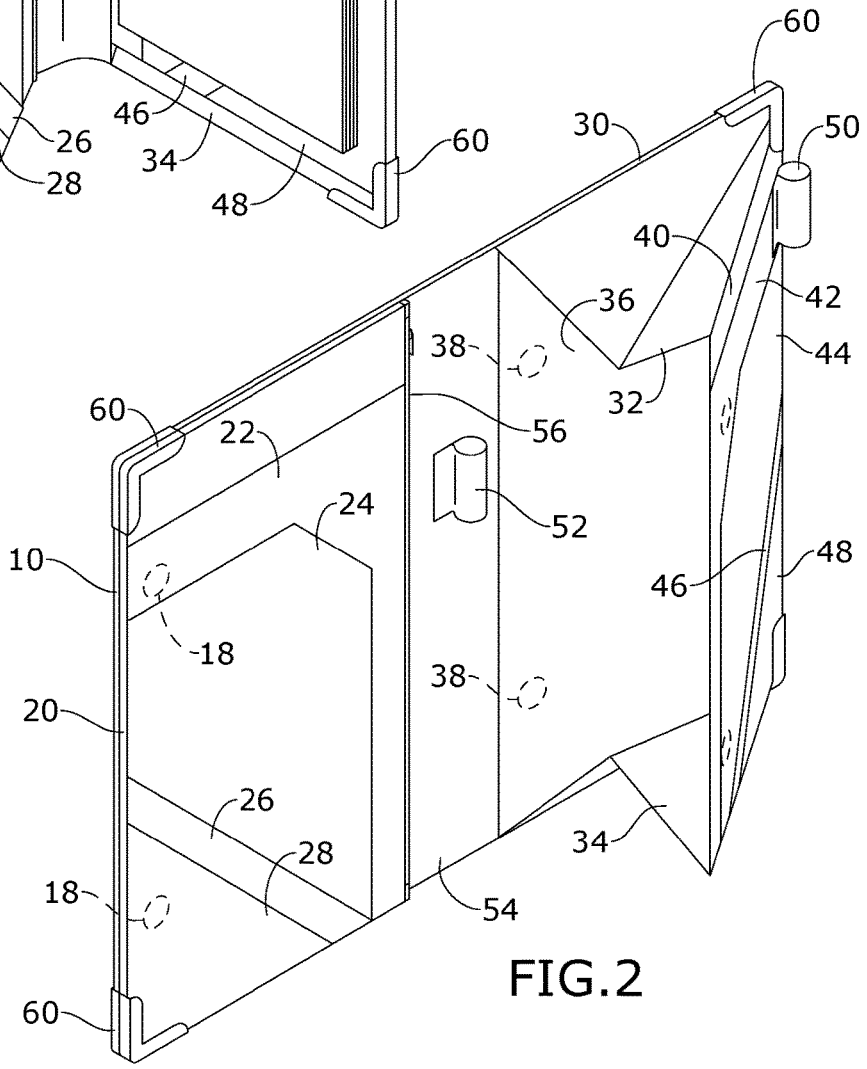
FIG. 2 shows a perspective view of one embodiment of the present invention with the rear slot open.
Figure 3:
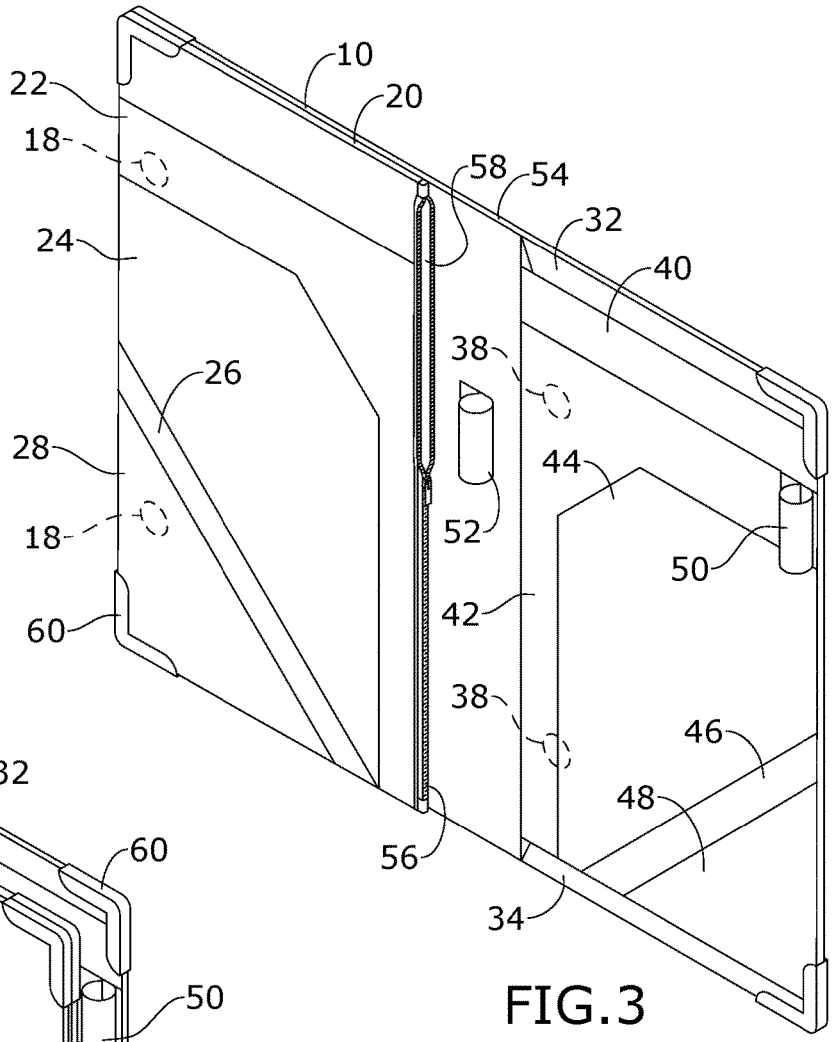
FIG. 3 shows a perspective view of one embodiment of the present invention with the zipper open.
Figure 4:
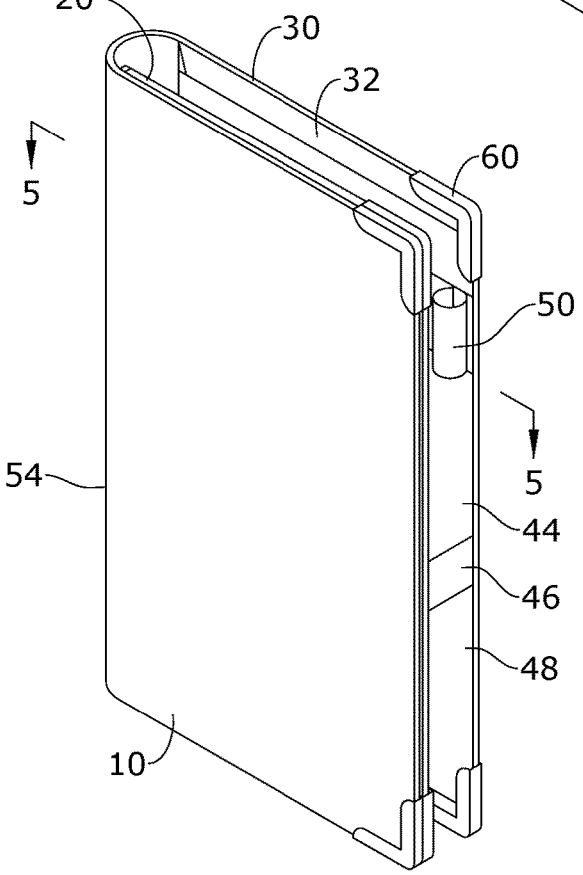
FIG. 4 shows a perspective view of one embodiment of the present invention in a closed position.
Figure 5:
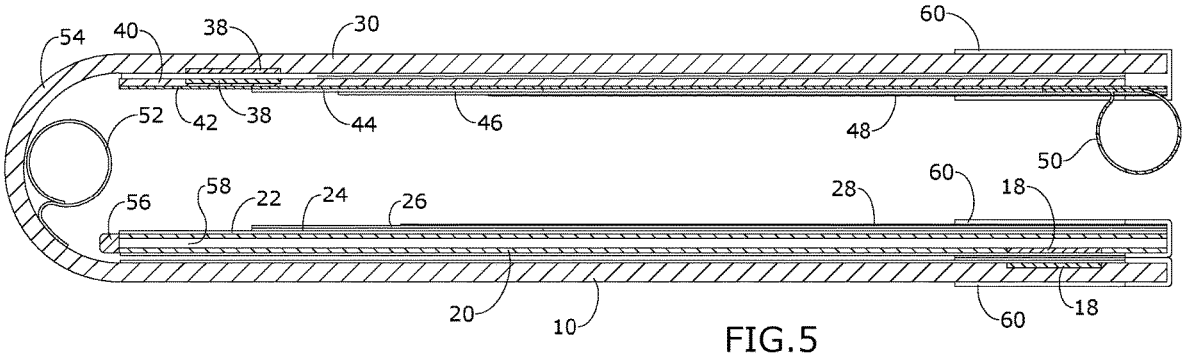
FIG. 5 shows a section view of one embodiment of the present invention taken along line 5-5 in FIG. 4.
Figure 6:
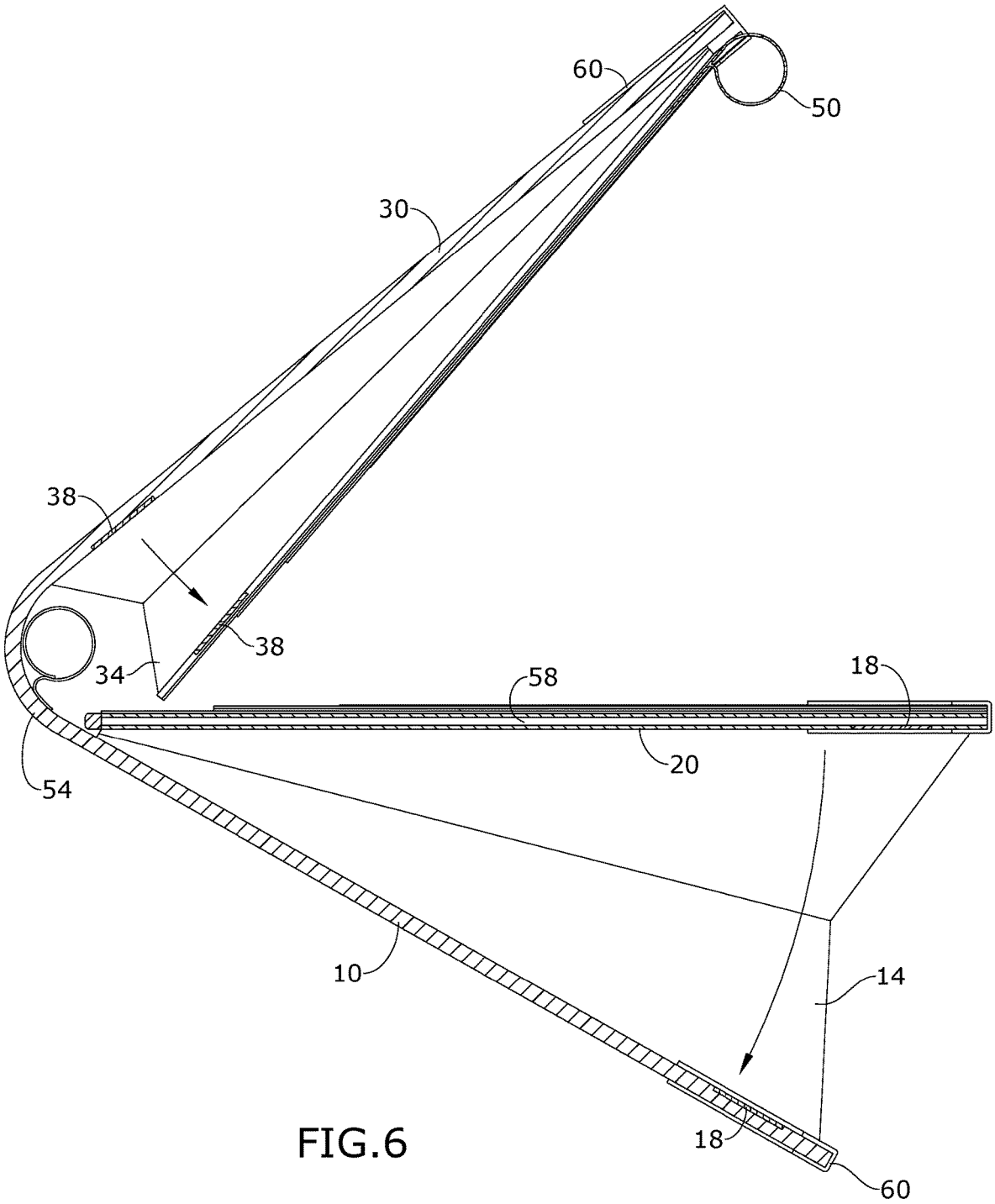
FIG. 6 shows a section view of one embodiment of the present invention illustrating the opening of the front pocket and the rear pocket.

By way of example, and referring to FIG. 1, one embodiment of a wallet assembly comprises a front panel 10 joined to a mid panel 20 with a front upper gusset panel 12 and a front lower gusset panel 14. This forms a front pocket 16 between the front panel 10, the mid panel 20, the front upper gusset panel 12 and the front lower gusset panel 14.

The mid panel 20 further comprises a mid panel front side, which is joined to the front upper gusset panel 12 and the front lower gusset panel 14, and a mid panel rear side. The mid panel front side is joined to a mid panel front side plurality of fastener magnets 18. Likewise, the front panel has a front panel rear side joined to a front panel front side plurality of fastener magnets 18. The mid panel front side plurality of fastener magnets 18 can be magnetically coupled to the front panel front side plurality of fastener magnets 18 to close the front pocket 16.

The mid panel rear side is joined to a mid panel rear side first flap 22, and a mid panel rear side second flap 24. The mid panel rear side is further joined to a mid panel first corner flap 26 and a mid panel second corner flap 28.

The front panel 10 is joined to a rear panel 30 with a spine 54. The rear panel 30 is joined to a rear opening panel 40 with a rear upper gusset panel 32 and a rear lower gusset panel 34. This forms a rear pocket 36 between the rear panel 30, the rear opening panel 40, the rear upper gusset panel 32, and the rear lower gusset panel 34.

The rear opening panel 40 further comprises a rear panel rear side, which is joined to the rear upper gusset panel 32 and the rear lower gusset panel 34, and a rear opening panel front side. The rear opening panel rear side is joined to a rear opening panel rear side plurality of fastener magnets 38. Likewise, the rear panel has a rear panel front side joined to a rear panel front side plurality of fastener magnets 38. The rear opening panel rear side plurality of fastener magnets 38 can be magnetically coupled to the rear panel front side plurality of fastener magnets 38 to close the rear pocket 36.

The rear opening panel front side is joined to a rear opening panel front side first flap 42, and a rear opening panel front side second flap 44. The rear opening panel front side is further joined to a rear opening panel front side first corner flap 46, a rear opening panel front side second corner flap 48, and a rear opening panel front side pen holder 50.

The spine 54 further comprises a spine pen holder 52. The spine 54 further comprises a coin pocket 58 which can be accessed with a zipper 56. Corners of the front panel 10, mid panel 20 and rear panel 30 can be reinforced with corner guards 60.

In use a user may be able to insert a check pad 62 into the rear opening panel front side first flap 42. A user can insert a pen 64 into the rear opening panel front side pen holder 50, the spine pen holder 52 or both of these. A user can insert a credit card 66 into mid panel second corner flap 28. A user can insert currency 68 into the front pocket 16.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A wallet assembly, configured to provide space for wait staff to perform food ordering services; the wallet assembly comprising:

a front panel joined to a mid panel with a front upper gusset panel and a front lower gusset panel forming a front pocket therebetween; wherein the front panel further comprises a front panel front side and a front panel rear side; wherein the mid panel further comprises a mid panel front side and a mid panel rear side a rear panel, joined to the front panel and the mid panel with a spine; wherein the rear panel further comprises a rear panel front side and a rear panel rear side;

a rear opening panel, joined to the rear panel with a rear upper gusset and a rear lower gusset forming a rear pocket therebetween; wherein the rear opening panel further comprises a rear opening panel front side and a rear opening panel rear side;

wherein the front pocket and the rear pocket are configured to provide wait staff with storage for performing food ordering services.

2. The wallet assembly of claim 1, further comprising:

a front panel front side plurality of fastener magnets, joined to the front panel rear side;

a mid panel front side plurality of fastener magnets, joined to the mid panel front side;

wherein magnetically coupling the front panel front side plurality of fastener magnets to the mid panel front side plurality of fastener magnets closes the front pocket.

3. The wallet assembly of claim 2, further comprising to a mid panel rear side first flap, a mid panel rear side second flap, a mid panel first corner flap, and a mid panel second corner flap joined to the mid panel rear side.

4. The wallet assembly of claim 3, further comprising:

a rear panel front side plurality of fastener magnets, joined to the rear panel front side;

a rear opening panel rear side plurality of fastener magnets, joined to the rear opening panel rear side;

wherein magnetically coupling the rear panel front side plurality of fastener magnets to the rear opening panel rear side plurality of fastener magnets closes the rear pocket.

5. The wallet assembly of claim 4, further comprising to a rear opening panel front side first flap, a rear opening panel front side second flap, a rear opening panel first corner flap, a rear opening panel second corner flap joined to the rear opening panel front side, and a rear opening panel front side pen holder.

6. The wallet assembly of claim 5, further comprising a coin pocket, joined to the spine and configured to be accessed with a zipper.

* * * * *